United States Patent [19]

Siddall

[11] 4,233,062

[45] Nov. 11, 1980

[54] ATOMIZATION INTO A CHAMBER HELD AT REDUCED PRESSURE

[75] Inventor: Richard J. Siddall, Ross-On-Wye, England

[73] Assignee: Huntington Alloys Inc., Huntington, W. Va.

[21] Appl. No.: 932,327

[22] Filed: Aug. 9, 1978

[30] Foreign Application Priority Data

Oct. 8, 1977 [GB] United Kingdom ..... 33555/77

[51] Int. Cl.[3] ..... B22D 23/08; C21C 7/00

[52] U.S. Cl. ..... 75/0.5 C; 264/12; 266/202

[58] Field of Search ..... 75/0.5 B, 0.5 BB, 0.5 BA, 75/0.5 BC, 0.5 C; 264/12; 266/202

[56] References Cited

U.S. PATENT DOCUMENTS

| | | | |
|---|---|---|---|
| 3,093,315 | 6/1963 | Tachiki et al. | 264/12 |
| 3,334,408 | 8/1967 | Ayers | 266/202 |
| 3,658,311 | 4/1972 | DiGiambattista | 75/0.5 B |
| 3,681,061 | 8/1972 | Fletcher | 75/0.5 C |
| 3,695,795 | 10/1972 | Jossick | 75/0.5 C |
| 3,840,623 | 10/1974 | Olsson et al. | 264/12 |
| 4,047,933 | 9/1977 | Larson et al. | 75/0.5 C |
| 4,069,045 | 1/1978 | Lundgren | 75/0.5 C |

FOREIGN PATENT DOCUMENTS

| | | | |
|---|---|---|---|
| 2006075 | 9/1970 | Fed. Rep. of Germany | 75/0.5 B |

OTHER PUBLICATIONS

Wentzell, J. M., "Metal Powder Production by Vacuum Atomization", J. Vac. Sci. Technol., vol. 11, No. 6, Nov./Dec. 1974, pp. 1035–1037.

*Primary Examiner*—L. Dewayne Rutledge
*Assistant Examiner*—Peter K. Skiff
*Attorney, Agent, or Firm*—R. J. Kenny

[57] ABSTRACT

Gas content of atomized metal powder can be reduced by conducting the atomization process at subatmospheric pressure and maintaining evacuation during atomization process.

7 Claims, 2 Drawing Figures

Figure 1:
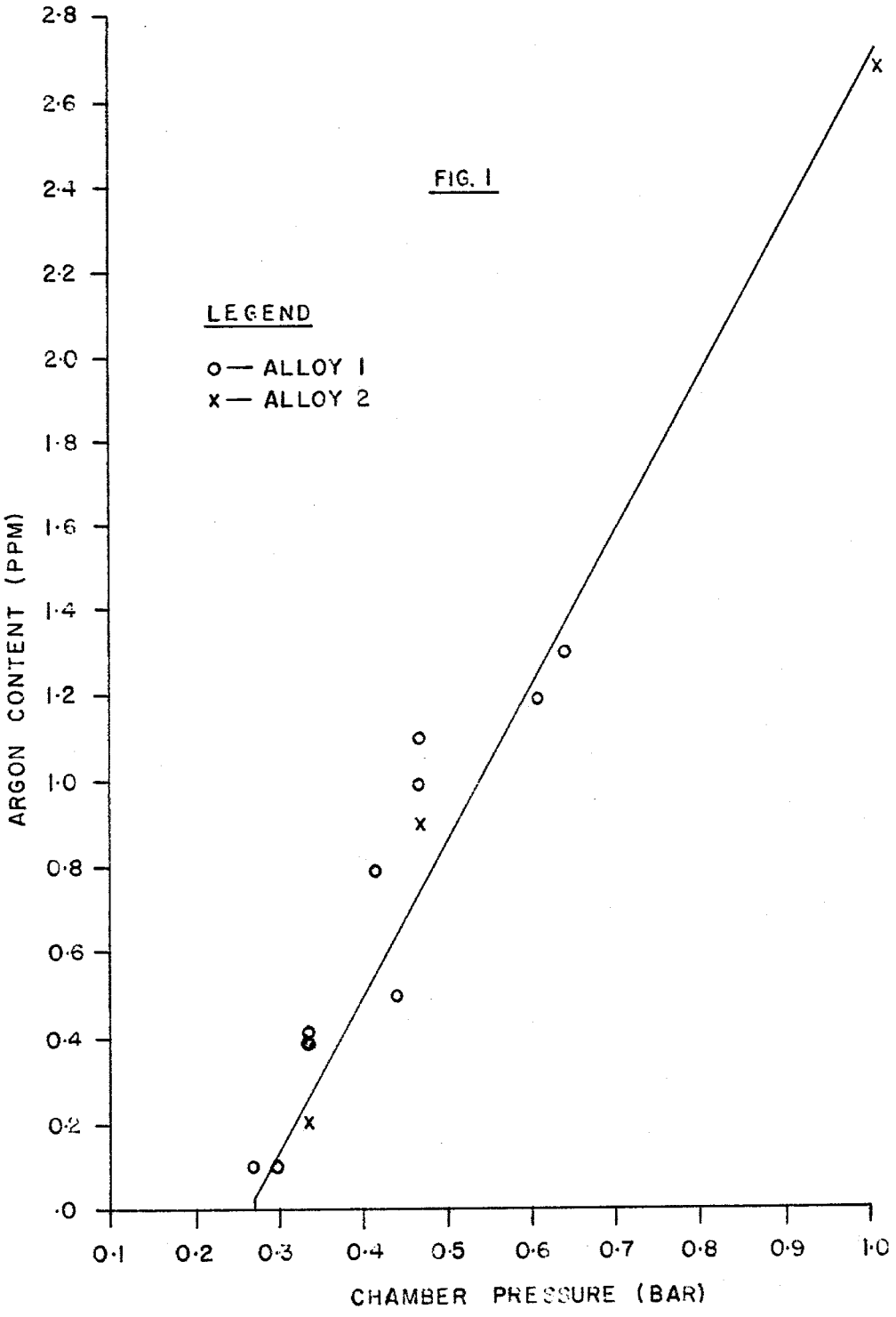

LEGEND
o — ALLOY 1
x — ALLOY 2
ARGON CONTENT (PPM)
2·8
2·6
2·4
2·2
2·0
1·8
1·6
1·4
1·2
1·0
0·8
0·6
0·4
0·2
·0
0·1
0·2
0·3
0·4
0·5
0·6
0·7
0·8
0·9
1·0
CHAMBER PRESSURE (BAR)

LEGEND
o — ALLOY 1
x — ALLOY 2
ARGON CONTENT (PPM)
2·8
2·6
2·4
2·2
2·0
1·8
1·6
1·4
1·2
1·0
0·8
0·6
0·4
0·2
0
0·1
0·2
0·3
0·4
0·5
0·6
0·7
0·8
0·9
1·0
CHAMBER PRESS (BAR)

ATOMIZATION INTO A CHAMBER HELD AT REDUCED PRESSURE

The present invention relates to atomized metal powders having low gas contents and to processes for their production.

Particles of gas-atomized powder frequently contain bubbles or pores containing entrapped atomizing gas. When the powder is compacted, for example, by hot isostatic pressing (HIPing), forging or extrusion, these pores close up. However, when the atomizing gas has a low solubility in the alloy, it may be evolved during a later heat treatment. This is particularly the case where argon is used to atomize nickel-based superalloys, in which it is almost insoluble. When the compacted powders are welded, the gas may be evolved and lead to a porous weld. Alternatively, if the powder is made into a component such as a turbine blade which is to be subjected to prolonged exposure at high temperatures, then microvoids may be formed. In practice, it is found that powder porosity is greatest in coarse powder fractions, and therefore the problem can be minimized by sieving out the coarse fractions. On the other hand, this is a severe commercial disadvantage because of the lowered yield of saleable product.

U.S. Pat. No. 4,047,933 discloses a process whereby gas entrapment in powder produced by inert gas atomization is reduced by the addition of one or more of the elements magnesium, calcium, lithium, silicon and rare earths to the molten alloy in an amount of 0.001 to 0.1% immediately prior to atomization. These elements tend to have relatively high surface activities and probably reduce the incidence of large particles enveloping small particles after interparticle collisions, which is thought to be one of the prime factors in porosity formation.

By contrast the present invention is based on the discovery that modification of the atomization process itself can lead to the production of low porosity powders.

Most forms of atomization equipment consist of a melting chamber, a tundish into which molten metal is tapped, and a tank in which the atomized metal is collected. The molten metal is teemed through a nozzle in the tundish to form a stream of metal and is disintegrated by directing a gas stream at high pressure against the metal stream so that it is separated into free droplets which are cooled to form powder. When sophisticated alloys are to be atomized, it is essential for the initial melting to be carried out under vacuum or under an inert gas. However, the nature of the process makes it difficult to isolate the melting chamber from the rest of the apparatus while atomizing and thus the whole assembly is housed in a chamber which can be evacuated and then maintained at reduced pressure during melting. It has been suggested that such a system be backfilled with the gaseous medium, preferably argon, prior to atomization, this was to prevent the problems that the pressure difference would cause in the process. These problems include difficulties in centering the metal stream in the gas stream and in stabilizing the process, and excessive splat formation caused by the powder particles "flying".

Even if this is not carried out, of course the pressure in the chamber rises once the atomization gas is supplied through the jets and atomization commences. Hitherto it has been believed that this quick return to atmospheric pressure before or immediately following commencement of atomization was extremely desirable because the rate of heat transfer is very high between the atomized particles and the atomizing gas, ensuring rapid cooling. Under vacuum it was believed that greatly reduced cooling would take place and that consequently splats of metal would be formed at the bottom of the chamber rather than powder.

It has now been discovered that if the atomization process is carried out at subatmospheric pressures and if evacuation of the chamber is continued during the atomization process, that then powder particles containing very low levels of entrapped gas can be produced.

According to the present invention, there is provided a process for the production of metal powder which comprises teeming molten metal through a nozzle to form a stream of molten metal and impacting the stream by at least one atomizing gas get to form metal powder, characterized in that a chamber in which the process takes place is evacuated to 0.5 bar (0.05 MPa) or below, and the pressure maintained at this level during the atomization process by continuing the evacuation, whereby gas entrapment in the powder is substantially lowered.

The process is applicable to the atomization of elemental metals or their alloys and is particularly useful when applied to nickel-, iron-, and cobalt-based superalloys. For such alloys an inert gas, such as argon, is used. It has been found, for example, that in the argon atomization of nickel-based alloys the amount of argon entrapped in the alloy powder in processes of the present invention is virtually independent of the mode of atomizing, and that when the pressure is maintained at 0.5 bar (0.05 MPa) the argon content is reduced to about one third of that experienced when the same alloys are atomized in a chamber at atmospheric pressure (0.1 MPa). In preferred processes the pressure is maintained at 0.37 bar (0.037 MPa) or below, when the argon content may be about $\frac{1}{8}$ of the norm. which, typically, is about 2 ppm by weight. Most advantageously, the chamber pressure is maintained at a pressure below 0.3 bar (0.03 MPa), whereby argon contents of less than 0.2 ppm (by weight) may be achieved.

While processes of the present invention may be applied to any proprietary equipment suitable for gas atomization, it is particularly usefully applied to the process disclosed and claimed in U.S. patent application No. 736,119, filed Oct. 27, 1976.

It must be observed that the conventional gas input rates used in proprietary apparatus or as disclosed in the above application should not be significantly reduced when operating the process of the present invention. Clearly it facilitates the maintenance of reduced pressure in the chamber when low gas input rates are utilized, but significant reduction in gas flow prevents sufficient cooling of the powder to have taken place before it reaches the chamber bottom. This leads to the production of more splatted particles than normal, and hence a coarser powder size distribution which is commercially unattractive.

The process of the present invention may be put into effect simply by installing at least one pumping device in the gas exhaust line from the atomization chamber of a conventional gas atomizer. It has been found particularly useful to use one or more water ring pumps in the exhaust line. This allows an extra advantage to be obtained since by wet scrubbing the exhaust gases there is reduction of the chance of pollution from fine powder particles entering the atmosphere.

Figure 2:
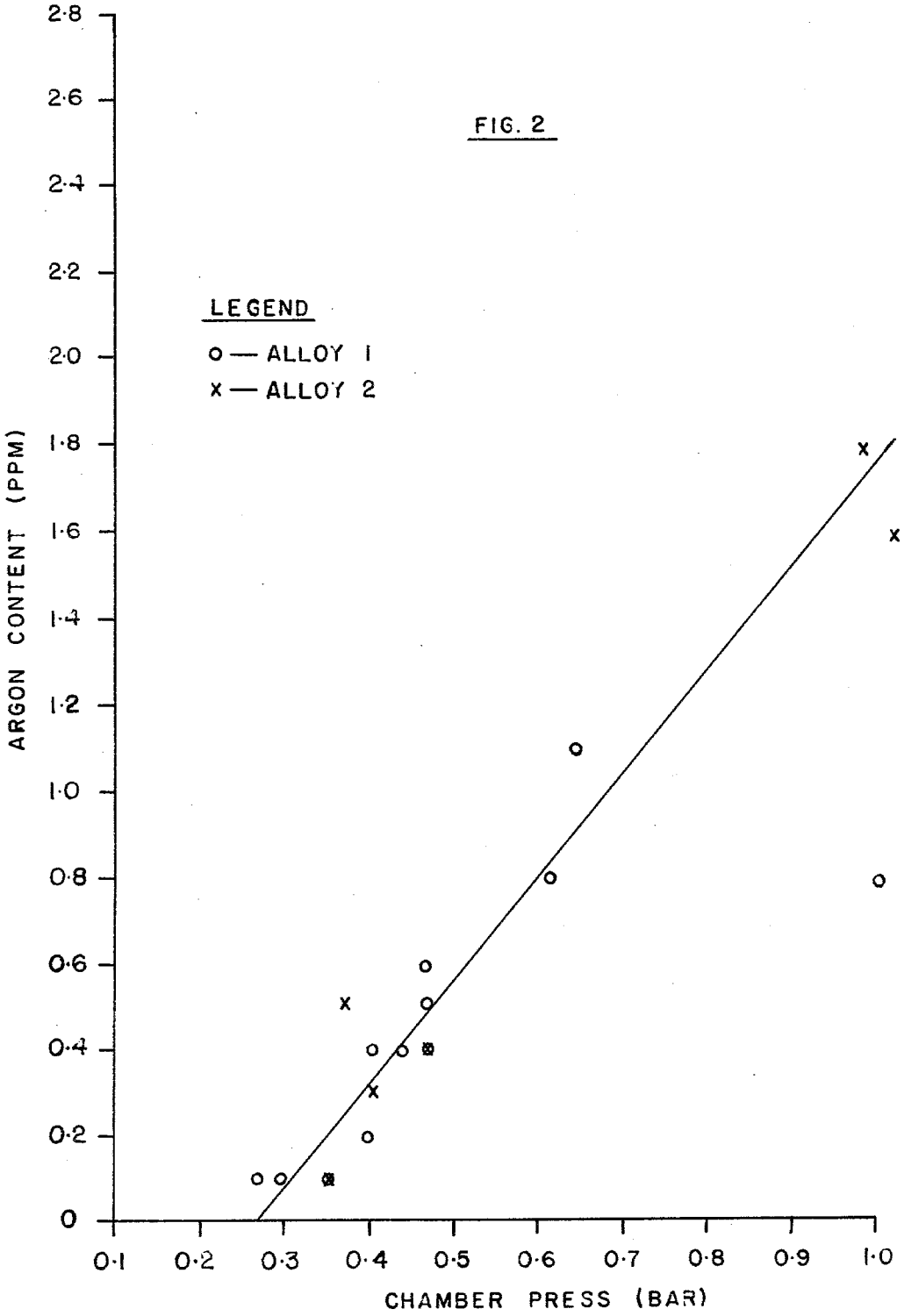

An example will be described with reference to the accompanying drawings in which FIG. 1 shows the effect of chamber pressure on argon content of $-425+150$ μm powder, and FIG. 2 shows the effect of chamber pressure on the argon content of $-425$ μm powder.

A gas atomizer of the type described and claimed in U.S. Pat. application No. 736,119 was used in a series of comparative tests in which atomizations were carried out with the atomizing chamber held at a variety of pressures. The apparatus consisted of a tundish having a nozzle located above an annular plenum chamber, so that in use molten metal teemed through the nozzle passes through the central hole of the plenum chamber, and two series, each of four jets, arranged to direct jets of argon at the molten stream at included angles of 22° and 25° respectively, at a gas rate capable of 0.236 $cm^3$/sec of argon, at 1724 $KN/m^2$. A water ring pump of 0.505 $m^3$/sec capacity at 0.5 bar was installed in the argon exhaust line. Chamber pressures were varied by changing the gas input rates of the atomizing jets and/or bleeding air at the water ring pump. 17 heats, each 500 kg, of an alloy having the nominal composition 20% chromium, 80% nickel, and 6 heats of a nickel-based superalloy having the nominal composition, 0.03 C, 15.0 Cr, 3.5 Ti, 4.0 Al, 17.0 Co, 5.0 Mo, Bal Ni, were used for the tests. Samples of $-425$ μm bulk skip powder and $-425+150$ μm skip powder from each heat were analyzed for argon.

FIGS. 1 and 2 depict the average chamber pressure versus argon contents for the $-425+150$ μm powder and the $-425$ μm powder respectively and show that, allowing for sampling and experimental errors, the amount of argon trapped in the powder is directly related to the chamber pressure. What is particularly striking is the extremely low retained gas content evidence upon evacuating the chamber to less than 0.5 bar, particularly below about 0.3 bar. This unexpected phenomenon would be expected to markedly minimize the severity of problems attendant subsequent processing of the powders into useable products.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. In a process for the production of metal powder by atomization of a molten metal stream in which a gaseous medium is impinged there against, the improvement which comprises reducing the gas entrapment of the metal powder produced by conducting the atomization process at a subatmospheric pressure of about 0.5 bar (0.05 M Pa) or below during the atomization period in which said gaseous medium impinges against said molten metal stream and maintaining said subatmospheric pressure at said level until the process is substantially complete.

2. A process in accordance with claim 1 in which the metal atomized is a nickel-, iron-, or cobalt-based alloy.

3. A process in accordance with claim 1 in which the atomizing gas is argon.

4. A process in accordance with claim 1 in which the pressure is maintained at 0.37 bar (0.037 MPa) or below.

5. A process in accordance with claim 3 in which the pressure is maintained below about 0.3 bar (0.03 MPa) and whereby the argon content of the metal powder produced is 0.2 ppm or less.

6. A process in accordance with claim 1 in which at least one water ring pump is used for evacuation.

7. Metal powder produced in accordance with claim 1.

* * * * *